United States Patent [19]

Kikuchi

[11] Patent Number: 4,968,232

[45] Date of Patent: Nov. 6, 1990

[54] AXIAL SEALING MECHANISM FOR A SCROLL TYPE COMPRESSOR

[75] Inventor: Kazuto Kikuchi, Honjo, Japan

[73] Assignee: Sanden Corporation, Gunma, Japan

[21] Appl. No.: 342,078

[22] Filed: Apr. 24, 1989

[30] Foreign Application Priority Data

Apr. 22, 1988 [JP] Japan ..... 63-98393

[51] Int. Cl.[5] ..... F04C 18/04

[52] U.S. Cl. ..... 418/55.5; 418/57

[58] Field of Search ..... 418/55 D, 57

[56] References Cited

U.S. PATENT DOCUMENTS

| | | | |
|---|---|---|---|
| 3,884,599 | 5/1975 | Young et al. | 418/55 D |
| 4,332,535 | 6/1982 | Terauchi et al. | 418/94 |
| 4,475,874 | 10/1984 | Sato | 418/55 D |
| 4,527,963 | 7/1985 | Terauchi | 418/100 |
| 4,538,975 | 9/1985 | Tsukagoshi | 418/DIG. 1 |
| 4,561,832 | 12/1985 | Shimizu | 418/55 C |

FOREIGN PATENT DOCUMENTS

| | | | |
|---|---|---|---|
| 60-166779 | 8/1985 | Japan | 418/57 |
| 60-224987 | 11/1985 | Japan . | |
| 60-228787 | 11/1985 | Japan . | |
| 60-228788 | 11/1985 | Japan . | |
| 62-168986 | 7/1987 | Japan | 418/55 D |
| 60-178789 | 8/1987 | Japan . | |

*Primary Examiner*—John J. Vrablik

*Attorney, Agent, or Firm*—Banner, Birch, McKie & Beckett

[57] ABSTRACT

This invention discloses an axial sealing mechanism for axially sealing an orbiting scroll and a fixed scroll of a scroll type compressor. The compressor includes a driving mechanism for driving the orbiting scroll in an orbital motion and a block member fixedly attached to the housing of the scroll compressor to support the driving mechanism. The block member and the fixed scroll define an intermediate chamber in which the orbiting scroll is disposed. The intermediate chamber is divided into a first and second chamber by an end plate of the orbiting scroll. A first conduit, which is sized to produce a pressure throttling effect, links the second chamber and the discharge chamber of the compressor to increase the pressure in the intermediate chamber. A second conduit, which also is sized to produce a pressure throttling effect, links the second chamber to the suction chamber of the compressor. During operation of the compressor, the second chamber is maintained at an intermediate pressure without pressure fluctuation due to the presence of the first and second conduits. This intermediate pressure provides a constant urging force against the orbiting scroll to urge it against the fixed scroll to obtain a good axial seal between both scrolls without decreasing the durability of the driving mechanism and the rotation preventing mechanism.

13 Claims, 3 Drawing Sheets

AXIAL SEALING MECHANISM FOR A SCROLL TYPE COMPRESSOR

BACKGROUND OF THE INVENTION

1. Field Of The Invention

This invention relates to a scroll type compressor, and more particularly, to an axial sealing mechanism for the scroll members of a scroll type compressor.

2. Description Of The Prior Art

A conventional scroll type compressor with an axial sealing mechanism for axially sealing the scroll members is illustrated in FIG. 1. The axial sealing mechanism shown in FIG. 1 is similar to the axial sealing mechanism described in U.S. Pat. No. 4,475,874. The scroll type compressor includes fixed scroll 10 having circular end plate 11 from which spiral element 12 extends, and orbiting scroll 20 having circular end plate 21 from which spiral element 22 extends. Block member 30 is attached to circular end plate 11 by a plurality of fastening members, such as bolts 31, to define chamber 40 in which orbiting scroll 20 is disposed. Spiral elements 12 and 22 are interfitted at an angular and radial offset to make a plurality of line contacts to define at least one pair of sealed-off pockets. Driving mechanism 50, which includes rotatably supported drive shaft 51, is connected to orbiting scroll 20 to effect the orbital motion of orbiting scroll 20. Oldham coupling 60 is disposed between circular end plate 21 and block member 30 to prevent the rotation of orbiting scroll 20 during its orbital motion.

Circular end plate 21 of orbiting scroll 20 divides chamber 40 into first chamber 41 in which spiral elements 12 and 22 are disposed and second chamber 42 in which Oldham coupling 60 and one end of driving mechanism 50 are disposed. Discharge port 70 is formed at a central portion of circular end plate 11 to discharge the compressed fluid from a central fluid pocket. Suction port 80 is formed at a peripheral portion of circular end plate 11 to supply suction fluid to the outermost fluid pockets. A pair of apertures 90 which are sized to produce a pressure throttling effect are formed at a middle portion of circular end plate 21 of orbiting scroll 20 to link second chamber 42 to a pair of intermediately compressed fluid pockets 41*a*.

During operation of the compressor, since the pressure in intermediate fluid pockets 41*a* facing aperture 90 fluctuates within a defined range, thus, even in a stable operating condition of the compressor, the pressure in second chamber 42, which is connected with intermediate fluid pockets 41*a* by apertures 90, is an average pressure which is related to the range of pressures in intermediate fluid pockets 41*a*. Accordingly, the axial sealing force applied against orbiting scroll 20 to urge it against fixed scroll 10 is a function of the average intermediate pressure in second chamber 42.

One of the disadvantages of the above prior art axial sealing mechanism is that, since second chamber 42 admits the intermediately compressed fluid from intermediate fluid pocket 41*a* in which pressure fluctuates within a range of pressures, the pressure in second chamber 42 also fluctuates thereby varying the axial sealing force applied to the orbiting scroll. This occurs even in the stable operating condition of the compressor. As a result, Oldham coupling 60 and driving mechanism 50 intermittently receive an undesirable thrust force which is generated by the reaction force to the compressed fluid in all the fluid pockets. This reduces the durability of the compressor.

Another disadvantage of the above prior art axial sealing mechanism is that the machining process for forming aperture 90 in circular end plate 21 must be very precise, which increases manufacturing cost and may lead to reduced operating efficiency in the event precise tolerances are not observed.

SUMMARY OF THE INVENTION

It is a primary object of this invention to provide an axial sealing mechanism for a pair of scroll members of a scroll type compressor in which a constant axial force is generated. In this regard, the axial sealing mechanism of the present invention generates a constant axial force against an end plate of the orbiting scroll to urge it against the fixed scroll to thereby axially seal the scrolls.

Another object of the present invention is to provide an axial sealing mechanism for a scroll type compressor which is easy and inexpensive to manufacture and does not require high precision machining.

Another object of the present invention is to provide an axial sealing mechanism for a scroll type compressor that improves the operating efficiency of the compressor.

A scroll type compressor includes a fixed scroll having a first end plate from which a first spiral element extends and an orbiting scroll having a second end plate from which a second spiral element extends. A block member is mounted within the compressor housing and attached to the first end plate to define a chamber in which the orbiting scroll is disposed. The first and second spiral elements interfit at an angular and radial offset to make a plurality of line contacts to define at least one pair of sealed-off fluid pockets. A discharge space formed within the housing receives compressed fluid discharged from a central fluid pocket defined by the interfitting spiral elements. A suction space formed within the housing receives suction fluid and supplies the suction fluid to the outermost fluid pockets defined by the spiral elements.

A driving mechanism including a rotatable drive shaft is connected to the orbiting scroll to effect the orbital motion of the orbiting scroll. A rotation-preventing mechanism for preventing the rotation of the orbiting scroll during its orbital motion is disposed between the block member and the second end plate. The volume of the fluid pockets is changed by the orbital motion of the orbiting scroll. The second end plate of the orbiting scroll divides the chamber into a first chamber in which the first and second spiral elements are disposed and a second chamber in which the rotation-preventing mechanism and one end of the drive shaft are disposed. A first throttled conduit links the second chamber to the discharge space and second throttled conduit links the second chamber to the suction space. These throttled conduits pass compressed fluid to and from the second chamber to establish a substantially constant intermediate pressure in the second chamber to thereby apply a substantially constant axial sealing force to said orbiting and fixed scrolls.

DETAILED DESCRIPTION OF THE PREFERRED EMBODIMENTS

Figure 1:
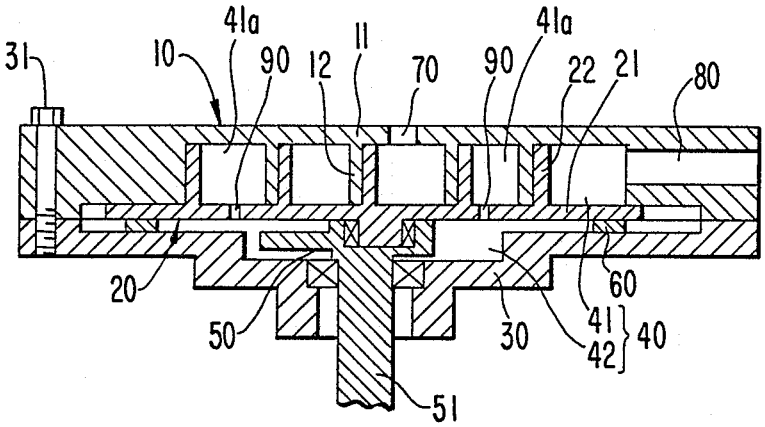
FIG. 1 PRIOR ART
FIG. 1 is a vertical sectional view of a conventional scroll type compressor.
Figure 2:
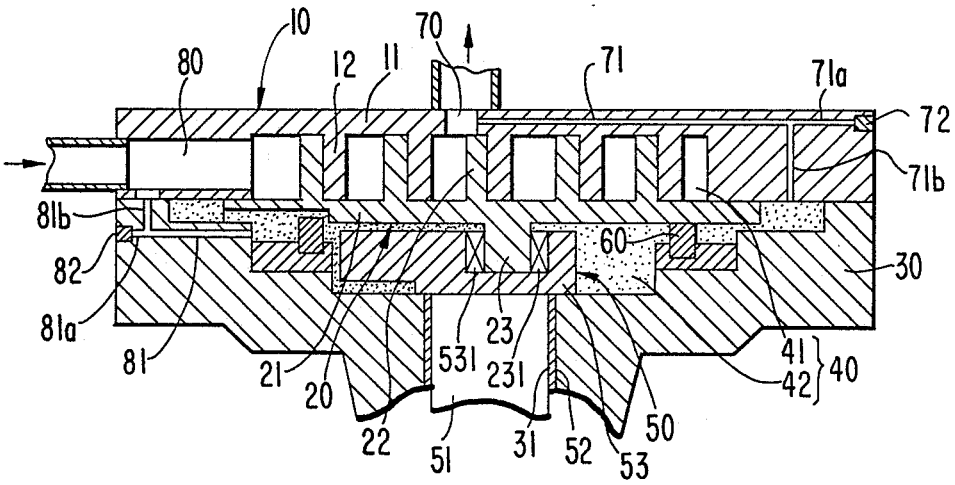
FIG. 2 is a vertical sectional view of a scroll type compressor in accordance with a first embodiment of the present invention.

A first embodiment of the present invention as applied to a scroll type compressor for use in a refrigerant circuit is illustrated in FIG. 2. The same numerals are used in FIG. 2 to denote the corresponding elements shown in FIG. 1, and the explanation of those elements is omitted. In this embodiment, drive shaft 51 is rotatably supported in bore 31 which is centrally formed in block member 30. Bearing 52 is disposed between an outer peripheral surface of drive shaft 51 and an inner peripheral surface of bore 31. One end of drive shaft 51 is fixedly attached to bushing 53, which is disposed within second chamber 42. Circular boss 23 projects from an end surface opposite spiral element 22 of orbiting scroll 20 and is rotatably inserted into circular depression 531 of bushing 53. The center of circular boss 23 is radially offset from the center of drive shaft 51, and circular boss 23 is supported in circular depression 531 by bearing 231.

Conduit or aperture 71, which is formed in circular end plate 11 of fixed scroll 10, includes first conduit or aperture **71*a* and second conduit or aperture 71*b*. These apertures 71*a* and 71*b* are sized to produce a pressure throttling effect as further described below. First aperture 71*a* extends radially in circular end plate 11 from an outer peripheral surface of circular end plate 11 to an inner peripheral wall of discharge port 70. Second aperature 71*b* extends axially in circular end plate 11 from first aperture 71*a* to second chamber 42. Plug 72 is fixedly attached to the outer peripheral surface of circular end plate 11 to close the outer radial end of first aperture 71*a*. Accordingly, aperture 71 links discharge port 70 to second chamber 42**.

Conduit or aperture 81, which is formed in block member 30, includes third conduit or aperture **81*a* and fourth conduit or aperture 81*b*. These apertures 81*a* and 81*b* also are sized to produce a pressure throttling effect as further described below. Third aperature 81*a* extends radially in block member 30 from an outer peripheral surface of block member 30 to an inner surface of block member 30 which partially defines second chamber 42. Fourth aperture 81*b* extends axially in block member 30 to connect third aperture 81*a* to suction port 80. Plug 82 is fixedly attached to the outer peripheral surface of block member 30 to close the outer radial end of third aperture 81*a*. Accordingly, aperture 81 links suction port 80 to second chamber 42**.

During operation of the compressor, a portion of the refrigerant gas discharged through discharge port 70 flows into second chamber 42 through aperture 71 at a reduced pressure by virtue of the throttling effect of aperture 71. A portion of the refrigerant gas in second chamber 42 also flows into suction port 80 through aperture 81 at a reduced pressure by virtue of the throttling effect of aperture 81. As a result, the pressure in second chamber 42 which urges orbiting scroll 20 to fixed scroll 10 is maintained at a value which is smaller than the discharge pressure and larger than the suction pressure, that is, an intermediate pressure. In particular, in the stable operating condition of the compressor, the pressure in second chamber 42 is maintained at an intermediate pressure with no pressure fluctuation since both the discharge and suction pressures are maintained constant. Accordingly, a good axial seal between orbiting scroll 20 and fixed scroll 10 is maintained without reducing durability of Oldham coupling 60 and driving mechanism 50. Furthermore, the desired axial sealing pressure (the intermediate pressure) in second chamber 42 can be obtained by selecting the appropriate diameter of apertures 71 and 81. Reduction of the compression capability of the compressor from the discharge gas blown through aperture 71, second chamber 42 and aperture 81 is minimal by virtue of the throttling effect of apertures 71 and 81.

Figure 3:
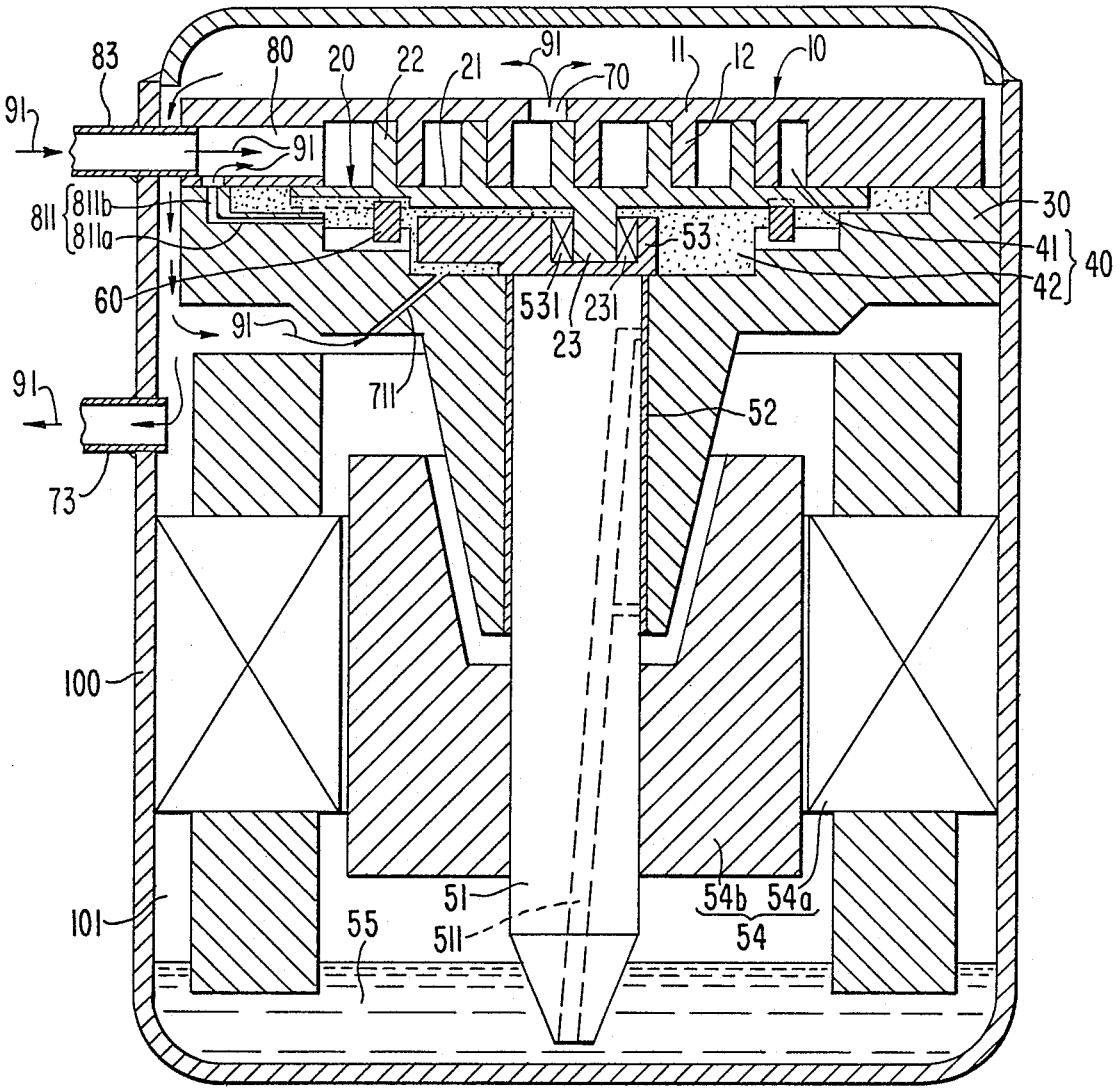
FIG. 3 is a vertical sectional view of a scroll type compressor in accordance with a second embodiment of the present invention.

FIG. 3 illustrates a second embodiment of the present invention applied to a hermetic type scroll compressor for use in a refrigerating circuit. In FIG. 3, the same numerals are used to denote the corresponding elements shown in FIG. 2 and the explanation of those elements is omitted. In this embodiment, fixed scroll 10, orbiting scroll 20, block member 30, driving mechanism 50 and Oldham coupling 60 are housed in hermetically sealed casing 100. Casing 100 further houses motor 54 for rotating drive shaft 51. Motor 54 includes ring-shaped stator **54*a* and ring-shaped rotor 54*b*. Stator 54*a* is firmly secured to an inner peripheral wall of casing 100 by forcible insertion and rotor 54*b* is firmly secured to drive shaft 51 by forcible insertion. Hole 511 is formed in drive shaft 51 to supply lubricating oil 55 collected in the bottom of casing 100 to a gap between an outer peripheral surface of drive shaft 51 and an inner peripheral surface of plain bearing 52**.

One end of radial inlet port 83, which is hermetically sealed to casing 100, is connected to suction port 80. One end of radial outlet port 73, which also is hermetically sealed to casing 100, is connected opened to inner space 101 of casing 100. Conduit or aperture 711, which is sized to produce a pressure throttling effect, is formed in block member 30 to connect second chamber 42 to inner space 101 of casing 100. Conduit or aperture 811, which also is sized to produce a pressure throttling effect, is formed in block member 30 to connect suction port 80 to second chamber 42. Aperture 811 includes radial aperture **811*a* and axial aperture 811*b***.

In operation, as arrows 91 in FIG. 3 indicate, suction gas entering suction port 80 from another element in the refrigerating circuit, such as an evaporator (not shown), flows through inlet port 83 into the outermost fluid pockets of the scroll elements. The suction gas is compressed by virtue of the orbital motion of orbiting scroll 20 and then is discharged through discharge port 70. In this type of hermetic scroll compressor, which is generally called a high pressure type hermetic scroll compressor, the discharged refrigerant gas fills inner space 101 of casing 100 except chamber 40. Only a small portion of the discharged refrigerant gas flows into second chamber 42 through aperture 711 at a reduced pressure due to the throttling effect of aperture 711. Most of the discharged refrigerant gas flows to another element of the refrigerating circuit, such as a condenser (not shown), through outlet port 73. The refrigerant gas which flows into second chamber 42 through aperture 711 flows into suction port 80 through aperture 811 at a pressure which is further reduced due to the throttling effect of aperture 811. This refrigerant gas merges with the suction gas. The effect obtained by apertures 711 and 811 is similar to the effect of apertures 71 and 81 described in the first embodiment so that the explanation thereof is omitted.

Figure 4:
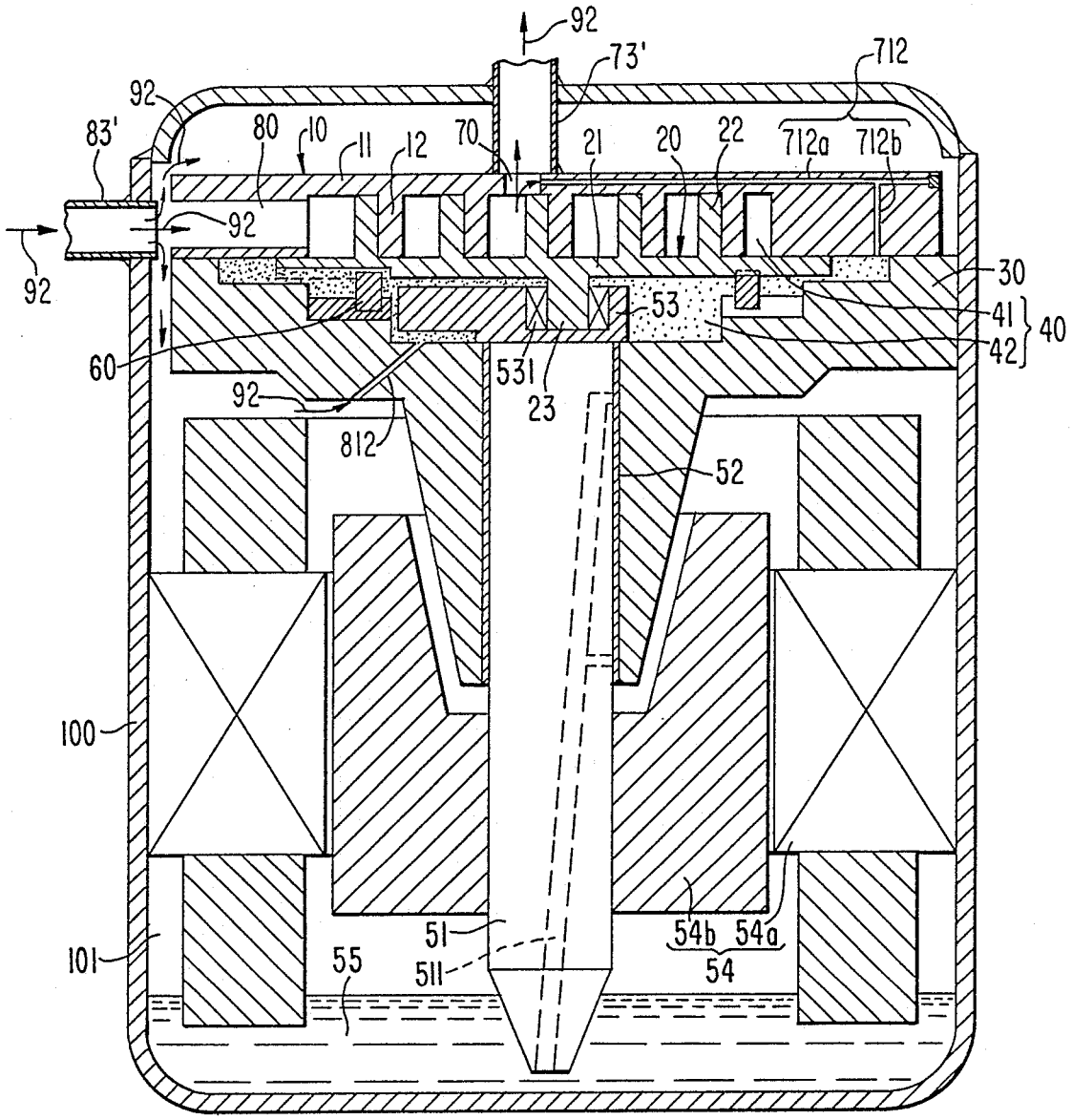
FIG. 4 is a vertical sectional view of a scroll type compressor in accordance with a third embodiment of the present invention.

FIG. 4 illustrates a third embodiment of the present invention, which also is applied to a hermetic type scroll compressor for use in a refrigerating circuit. In FIG. 4, the same numerals are used to denote the corresponding elements shown in FIG. 3, and the explanation of those elements is omitted. In this embodiment, one end of radial inlet port 83', which is hermetically sealed to casing 100, opens into inner space 101 of casing 100 adjacent suction port 80. One end of axial outlet port 73', which is hermetically sealed to casing 100, is connected to discharge port 70. Conduit or aperture 712, which is sized to produce a pressure throttling effect, is formed in circular end plate 11 and connects discharge port 70 to second chamber 42. Conduit or aperture 712 includes radial aperture **712*a* and axial aperture 712*b*. Conduit or aperture 812, which also is sized to produce a pressure throttling effect, is formed in block member 30, and connects second chamber 42 to inner space 101 of casing 100**.

In operation, as arrows 92 in FIG. 4 indicate, suction gas entering suction port 80 from another element in the refrigerating circuit, such as an evaporator (not shown), flows through inlet port 83' into the outermost fluid pockets of the scroll elements. The suction gas is compressed by virtue of the orbital motion of orbiting scroll 20 and then is discharged through discharge port 70. In this type of hermetic scroll compressor, which is generally called a low pressure type hermetic scroll compressor, a portion of the suction gas flows into and fills inner space 101 of casing 100 except chamber 40. Only a small portion of the discharged refrigerant gas flows into second chamber 42 through aperture 712 at a reduced pressure. Most of the discharged refrigerant gas flows to another element of the refrigerating circuit, such as a condenser (not shown), through outlet port 73'. The refrigerant gas which flows into second chamber 42 through aperture 712 flows into inner space 101 of casing 100 through aperture 812 at a pressure which is further reduced due to the throttling effect of aperture 812. This refrigerant gas merges with the suction gas. The effect obtained by apertures 712 and 812 is similar to the effect of apertures 71 and 81 shown in FIG. 2 so that the explanation thereof is omitted.

In the second and third embodiments of FIGS. 3 and 4, the present invention is applied to an hermetic type scroll compressor. However, the construction illustrated in this embodiments can be applied equally in an open type scroll compressor.

As pointed out previously, one of the advantages of this invention is that the machining process for forming the apertures need not be precise. Accordingly, improved axial sealing of the scroll elements can be achieved by a simple, easy to manufacture construction which does not adversely affect the overall operation of the scroll compressor.

Although illustrative embodiments have been described in detail with references to the accompanying drawings, it is to be understood that the invention is not limited to those precise embodiments. Various changes and modifications may be effected therein by one skilled in the art without departing from the scope or spirit of the invention.

I claim:

1. In a scroll type compressor including a housing, a fixed scroll having a first end plate from which a first spiral element extends, an orbiting scroll having a second end plate from which a second spiral element extends, a block member mounted in said housing in a fixed position relative to said first end plate to define an intermediate chamber in which said orbiting scroll is disposed, said first spiral element and said second spiral element interfitting at an angular and radial offset to make a plurality of line contacts to define at least one pair of sealed-off fluid pockets, a discharge space within said housing which receives compressed fluid discharged from a central fluid pocket defined by said first and second spiral elements, a suction space within said housing which receives suction fluid and passes the suction fluid to the radial outermost fluid pockets defined by said first and second spiral elements, a driving mechanism to effect the orbital motion of said orbiting scroll, and a rotation-preventing mechanism for preventing the rotation of said orbiting scroll during its orbital motion whereby the volume of the fluid pockets changes, said second end plate of said orbiting scroll dividing said intermediate chamber into a first chamber in which said first and second spiral elements are disposed and a second chamber in which said second end plate, said rotation-preventing mechanism and a portion of said drive mechanism are disposed, the improvement comprising:

a first throttled conduit linking said second chamber to said discharge space; and a second throttled conduit linking said second chamber to said suction space, said first and second throttled conduits passing compressed fluid to and from said second chamber to establish a substantially constant intermediate pressure in said second chamber to thereby apply a substantially constant axial sealing force between said orbiting and fixed scrolls.

2. The scroll type compressor of claim 1 wherein said housing comprises an hermetically sealed casing member, said casing member including an inner space in which compressed fluid from the central fluid pocket is discharged, said inner space including said discharge space.

3. The scroll type compressor of claim 2 wherein said first throttled conduit links said inner space and said second chamber.

4. The scroll type compressor of claim 1 wherein said housing comprises an hermetically sealed casing member, said casing member including an inner space in which suction fluid from the suction port is circulated, said inner space including said suction space.

5. The scroll type compressor of claim 4 wherein said second throttled conduit links said inner space and said second chamber.

6. The scroll type compressor of claim 5 wherein said discharge space is a discharge opening in said first end plate and said first throttled conduit links said discharge opening and said second chamber.

7. The scroll type compressor of claim 1 wherein said first throttled conduit is formed in said first end plate and said discharge space is a discharge opening in said first end plate.

8. The scroll type compressor of claim 7 wherein said first throttled conduit comprises a first radial portion extending from said discharge opening toward the peripheral surface of said first end plate and a second axial portion extending from said first radial portion to said second chamber.

9. The scroll type compressor of claim 8 wherein said first radial portion extends to the peripheral surface of said first end plate, said compressor further comprising a plug placed in the outer peripheral end of said first radial portion.

10. The scroll type compressor of claim 7 wherein said second throttled conduit is formed in said block member.

11. The scroll type compressor of claim 1 wherein said second throttled conduit is formed in said block member.

12. The scroll type compressor of claim 11 wherein said second throttled conduit comprises a first radial portion extending from said second chamber toward the peripheral surface of said block member and a second axial portion extending from said first radial portion to said suction space.

13. The scroll type compressor of claim 12 wherein said first radial portion extends to the peripheral surface of said block member, said compressor further comprising a plug placed in the outer peripheral end of said first radial portion.

* * * * *